US007640780B2

(12) United States Patent
Ruland

(10) Patent No.: US 7,640,780 B2
(45) Date of Patent: Jan. 5, 2010

(54) RAM RETRACTION SELECTION

(75) Inventor: Rodd R. Ruland, Amherst, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 470 days.

(21) Appl. No.: 11/473,496

(22) Filed: Jun. 23, 2006

(65) Prior Publication Data

US 2007/0295053 A1 Dec. 27, 2007

(51) Int. Cl.
*B21J 9/12* (2006.01)
*B21J 9/14* (2006.01)
*B21D 7/06* (2006.01)

(52) U.S. Cl. ..... 72/453.18; 72/453.16

(58) Field of Classification Search . 72/453.01–453.19, 72/416

See application file for complete search history.

(56) References Cited

U.S. PATENT DOCUMENTS

| | | | | |
|---|---|---|---|---|
| 3,085,168 | A | 4/1963 | Abel | |
| 4,604,890 | A | 8/1986 | Martin | 72/453.16 |
| 4,646,555 | A | 3/1987 | Postupack | 72/453.03 |
| 4,823,588 | A * | 4/1989 | Bussereau et al. | 72/453.06 |
| 5,113,679 | A | 5/1992 | Ferraro et al. | 72/21 |
| 5,195,042 | A * | 3/1993 | Ferraro et al. | 700/117 |
| 5,253,554 | A | 10/1993 | Riera et al. | 81/9 |
| 5,553,478 | A | 9/1996 | Di Troia | 72/453.15 |
| 5,657,417 | A | 8/1997 | Di Troia | 388/829 |
| 5,727,417 | A | 3/1998 | Moffatt et al. | 72/453.03 |
| 5,829,289 | A | 11/1998 | Fisher et al. | 72/19.9 |
| 6,138,346 | A | 10/2000 | Shutts et al. | 29/759 |
| 6,151,950 | A | 11/2000 | Wilhelm et al. | 72/409.01 |
| 6,196,045 | B1 | 3/2001 | Thomas et al. | 72/454 |
| 6,446,482 | B1 | 9/2002 | Heskey et al. | 72/453.16 |
| 6,986,274 | B2 | 1/2006 | Lefavour et al. | 72/453.16 |
| 2004/0168498 | A1 * | 9/2004 | Caporusso | 72/149 |

FOREIGN PATENT DOCUMENTS

| | | |
|---|---|---|
| GB | 2 355 378 | 1/1971 |

OTHER PUBLICATIONS

Huskie Tools Product Brochure, "Huskie Manual Hydraulic Tools CN-258 Service Entrance Crimper", 1 page.

* cited by examiner

*Primary Examiner*—Dana Ross
*Assistant Examiner*—Mohammad Yusuf
(74) *Attorney, Agent, or Firm*—Harrington & Smith, PC

(57) ABSTRACT

A compression tool including a ram; a drive system, a battery and a user selectable retraction control. The drive system is connected to the ram to extend the ram and allow retraction of the ram. The battery is connected to the drive system to at least partially power the drive system. The user selectable retraction control is connected to the drive system. The user selectable retraction control includes a plurality of ram retraction settings which are adapted to be selected by a user to at least partially control respective different retraction stopping locations of the ram.

18 Claims, 4 Drawing Sheets

RAM RETRACTION SELECTION

BACKGROUND OF THE INVENTION

1. Field of the Invention

The invention relates to a tool comprising an extendable and retractable ram and, more particularly, to a system for controlling retraction of the ram.

2. Brief Description of Prior Developments

U.S. Pat. Nos. 6,446,482 and 6,986,274 disclose battery powered hydraulic tool which comprises a ram. Normally, battery operated crimping tools employ a trigger-driven advance feature, in which the ram of the tool is advanced in order to crimp or press a connection together by forcing the ram of the tool into the head of the tool. With a connector between them, the connector is compressed or crimped by the movement of the ram. When the tool reaches a pre-determined internal pressure, an internal relief valve activates; preventing further pressure build-up within the tool.

When the crimp is complete, the user normally uses a trigger-driven retract feature. The trigger-driven retract feature, which either electromechanically or mechanically activates a release pin, returns the pressurized hydraulic fluid to a hydraulic fluid reservoir. When this occurs, the ram retracts to its original rear position with the aid of a spring pressing against the ram. The user can manipulate the trigger manually to minimize the amount of retraction by stopping the depression of the trigger at a certain time, but this can be tricky and inconsistent. There are tools known to the industry which employ mechanical 'stoppers' that prevent ram retraction past a certain amount; the Huskies CN258 crimper for example. However, such devices are employed on self-contained or remote manual hydraulic tools; not on battery hydraulic tools.

There is a need by users of battery powered crimping tools for a system for lengthening battery working life before recharging, and shortening crimp cycle timing. This is particularly acute for user who frequently crimp the same size of connector repeatedly.

SUMMARY OF THE INVENTION

In accordance with one aspect of the invention, a compression tool is provided including a ram; a drive system, a battery and a user selectable retraction control. The drive system is connected to the ram to extend the ram and allow retraction of the ram. The battery is connected to the drive system to at least partially power the drive system. The user selectable retraction control is connected to the drive system. The user selectable retraction control includes a plurality of ram retraction settings which are adapted to be selected by a user to at least partially control respective different retraction stopping locations of the ram.

In accordance with another aspect of the invention, a hydraulically operated, battery powered electrical connector crimp tool is provided comprising a frame; a battery connected to the frame; a hydraulic drive system on the frame, wherein the hydraulic drive system comprises a hydraulic pump connected to the battery; a ram connected to the hydraulic drive system, wherein the ram is adapted to be extended on the frame by hydraulic fluid from the hydraulic drive system; and a system for retracting the ram on the frame from an extended position. The system for retracting the ram comprises a hydraulic fluid release system and a user selectable control. The user selectable control comprises a rotatable selector member on the frame which is adapted to be moved to select a retraction location of the ram from the extended position.

In accordance with one method of the invention, a method of operating a hydraulically operated, battery powered electrical connector crimp tool is provided comprising extending a ram of the tool to an extended position; selecting a ram retraction setting on a user selectable control of the tool by a user, wherein the ram retraction setting at least partially determines an amount of retraction of the ram from the extended position; and retracting the ram from its extended position, wherein a location of stopping of the ram retraction from its extended position is at least partially controlled by the ram retraction setting selected by the user on the user selectable control.

In accordance with another aspect of the invention, a method of manufacturing a hydraulically operated, battery powered electrical connector crimp tool is provided comprising providing the tool with a system for retracting a ram on the frame from an extended position, wherein the system for retracting the ram comprises a hydraulic fluid release system; and connecting a user selectable ram retraction control to a frame of the tool, wherein the user selectable ram retraction control comprises a plurality of ram retraction settings for stopping retraction of the ram from its extended position at a plurality of respective different ram retracted positions.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
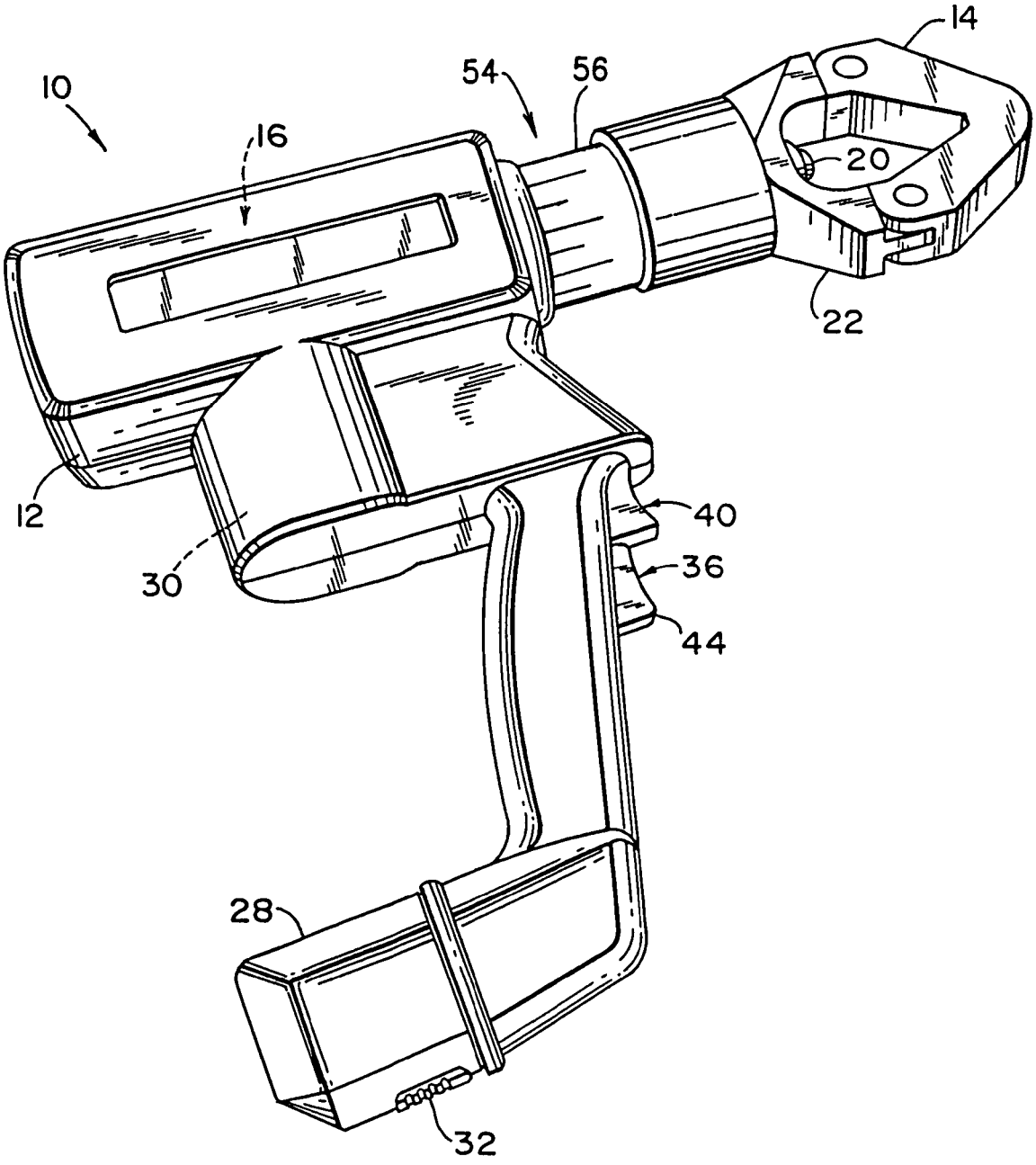
FIG. 1 is a perspective view of a crimping tool incorporating features of the invention.

Referring to FIG. 1 there is shown a perspective view of a tool 10 for crimping an electrical connector onto a conductor. Although features of the invention will be described with reference to the exemplary embodiments shown in the drawings, it should be understood that features of the invention can be embodied in various different types of alternate embodiments. In addition, any suitable size, shape, or type of materials or elements can be used.

Figure 2:
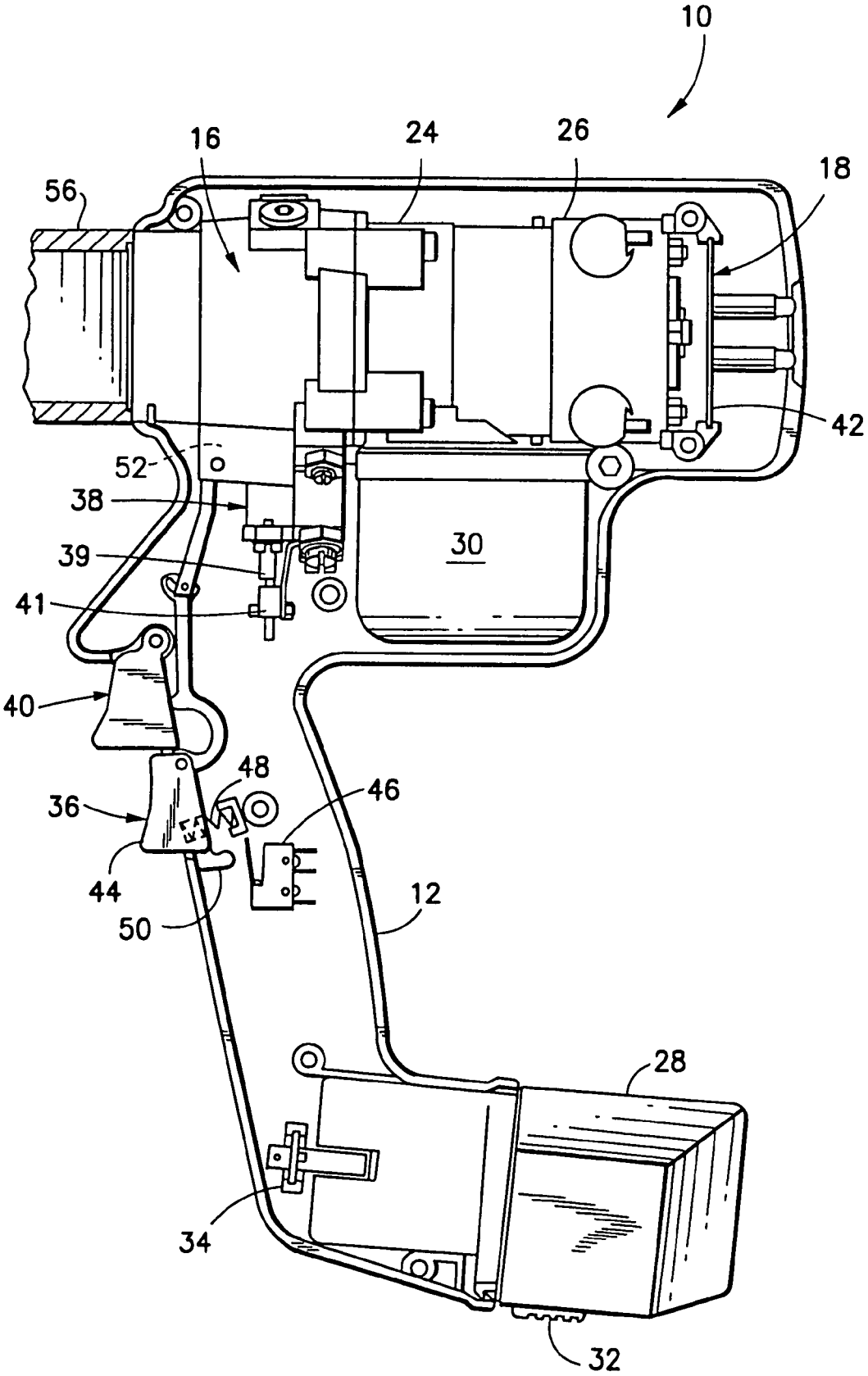
FIG. 2 is a schematic sectional view of the body of the tool shown in FIG. 1.

Referring also to FIG. 2, the tool 10 generally comprises a frame including a housing 12, a compression head 14, a drive system 16, and a drive control system 18. The compression head 14 is a well known part of crimping tools and includes a spring loaded ram 20 and a frame 22 that forms an anvil section for the ram. However, any suitable compression head could be provided. Removable crimping dies could also be provided.

The drive system 16 generally comprises a hydraulic pressure system with a pump 24, an electric motor 26, and a battery 28. The use of a hydraulic pressure system to move a ram is generally known in the art as seen by U.S. Pat. No. 5,113,679 which is hereby incorporated by reference in its entirety. Instead of the manually actuated pump disclosed in U.S. Pat. No. 5,113,679, the tool 10 uses the motor driven pump 24. In a preferred embodiment the pump 24 is similar to that described in U.S. Pat. Nos. 6,446,482 and 6,986,274 which are hereby incorporated by reference in their entireties. However, other types of pumps could be used. The hydraulic system includes a pressurized hydraulic reservoir 30 that the pump 24 can receive hydraulic fluid from and, which can receive hydraulic fluid from the compression head 14 as the ram 20 is being retracted. In the embodiment shown, the motor 26 is a high performance rare earth element permanent magnet motor manufactured by G.E.C.-Alsthom. However, in alternate embodiments, other types of motors could be used. The motor 26 is directly connected to the pump 24 without a gear transmission. The battery 28, in the embodiment shown, is an 18 volt removable rechargeable Ni-MH battery yielding 2.6 amp-hours of charge. However, in alternate embodiments, other types of batteries or power sources could be used. The battery 28 has a latch 32 for snap latching and removing the battery from connection with the housing 12. Located inside the housing 12 is a battery terminal 34 for making electrical connection with a connected battery.

The control system 18 generally comprises an activation trigger 36, a hydraulic system pressure switch or sensor 38, a release trigger 40, and a printed circuit board 42. The activation trigger 36 generally comprises a trigger member 44 and a microswitch 46. The trigger member 44 is pivotably mounted to the housing 12. A spring 48 is used to bias the trigger member 44 in a forward position. The trigger member 44 has a section 50 adapted to activate the microswitch 46 when the trigger member 44 is depressed by a user. The pressure sensor 38 is similar to the pressure sensor described in U.S. Pat. No. 5,113,679 with a spring loaded plunger 39 and a microswitch 41. When the hydraulic system pressure reaches a predetermined pressure, such as about 6,000 psi for example, the plunger 39 is moved by the hydraulic fluid. The spring (not shown) is compressed and the microswitch 41 is activated.

The release trigger 40 is connected to a release valve 50 coupled to the hydraulic system. The release valve 50 allows hydraulic fluid to return from the ram cylinder to the hydraulic fluid reservoir when the release trigger 40 is manually actuated by a user. As noted above, the ram 20 is a spring loaded ram. It is spring loaded towards a retracted position. Hydraulic fluid can be pumped by the hydraulic drive system to the ram cylinder of the frame to overcome the bias of the spring and drive the ram forward to an extended position. When the hydraulic fluid is released through the valve 52, the ram's spring can bias the ram from its extended position back towards its fully retracted position.

Figure 3:
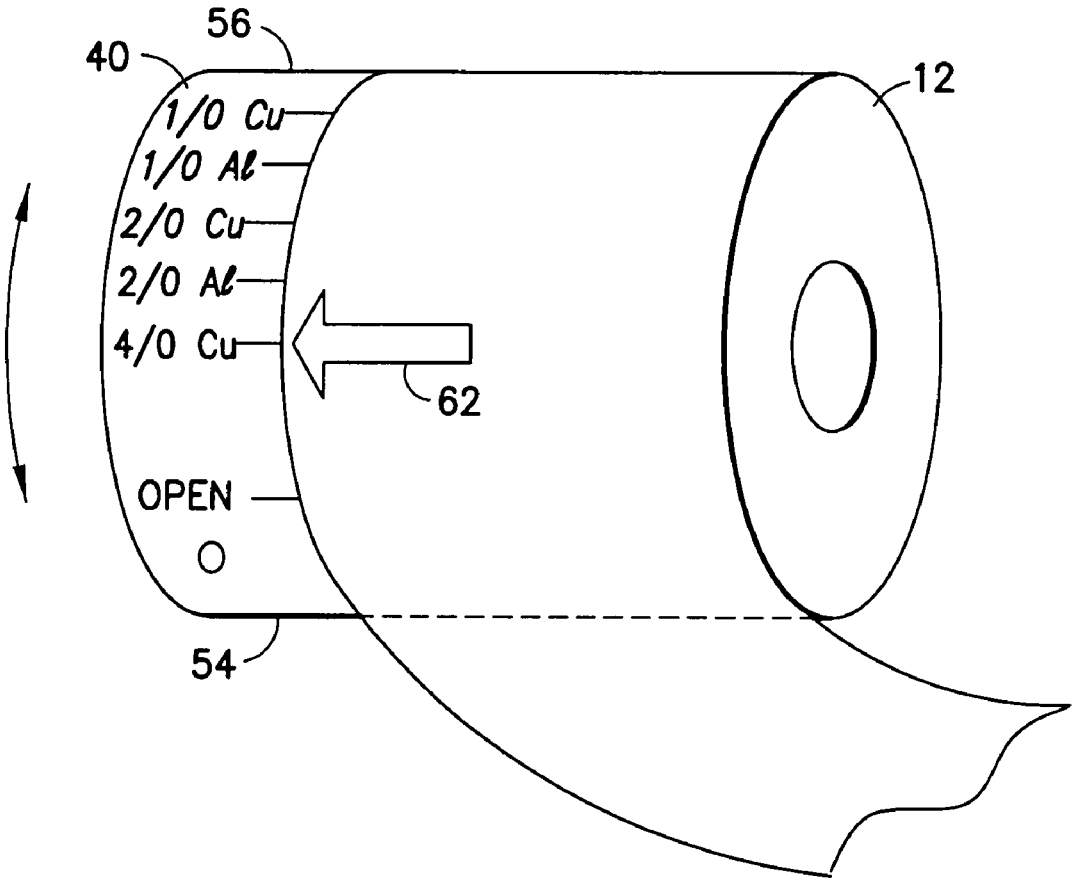
FIG. 3 is a schematic side view of portions of the tool shown in FIG. 1.
Figure 4:
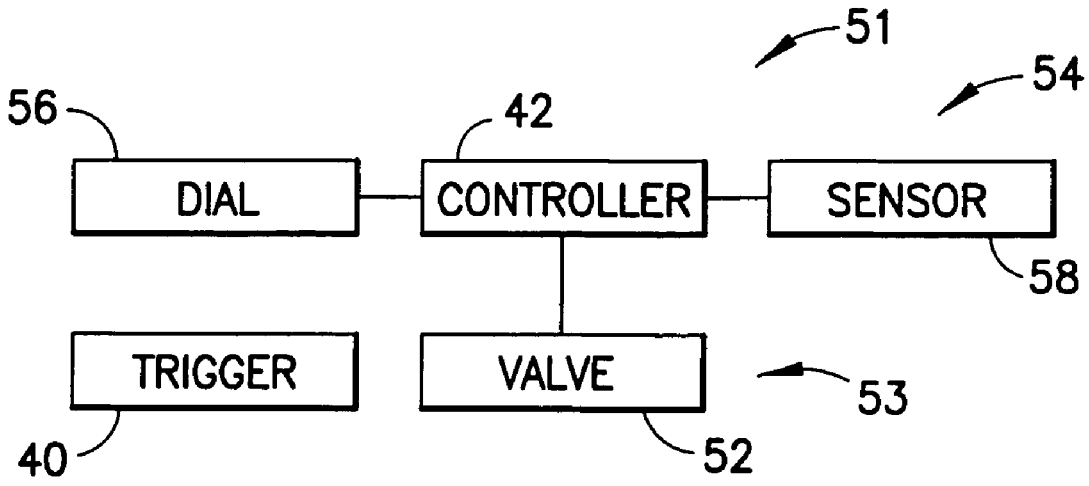
FIG. 4 is a block diagram showing some of the components of the tool shown in FIG. 1.

Referring also to FIGS. 3 and 4, in addition to the hydraulic fluid release system 53, the system 51 for retracting the ram on the frame from its extended position includes a user selectable control 54. The user selectable control 54 includes a rotatable selector member 56 on the frame. The rotatable selector member 56 is adapted to be moved by a user to select a desired retraction location of the ram 20 from its extended position. In particular, the user selectable control 54 provides a limiting function to limit reward retraction of the ram 20 for providing a plurality of retraction locations. In the embodiment shown, the rotatable selector member 56 comprises a dial or collar on the frame of the tool. In an alternate embodiment, the user selectable control could comprise any suitable type of selection system for a user to select one of a number of possible setting. For example, a rotatable knob or lever could be provided, or a slidable selector switch, or an electronic user interface with buttons or a touch screen, or mechanical buttons, etc. Any suitable user input section for selecting a retraction location and/or connector could be provided.

In this embodiment the user selectable control 54 includes the controller 42 and a sensor 58. The rotatable selector member 56 is operably coupled to the controller 42. The rotatable selector member 56 is adapted to send a signal to the controller 42 based upon the position or setting of the dial 56. The sensor 58, in this embodiment, is adapted to sense a characteristic of the hydraulic fluid function. In particular, the sensor 58 is adapted to sense a percentage or quantity of hydraulic fluid returned through the retracting system back to the fluid reservoir. However, in an alternate embodiment, any suitable type of sensor could be provided, such as a sensor adapted to sense the position or location of the ram 20 on the frame for example. The sensor 58 is coupled to the controller 42 to send a signal corresponding to its sensed characteristic to the controller 42. The controller 42 is also coupled to the release valve 52. In this embodiment the release valve 52 is adapted to be manually opened by the user trigger 40 and either manually closed by release of the trigger and/or automatically closed by the controller 42.

As shown best in FIG. 3, the dial 56 has a plurality of markings or indicia 60. The indicia 60 comprise electrical connector size and material indications, such as 1/0 Cu, 1/0 Al, 2/0 Cu, 2/0 Al, 4/0 Cu, etc. The frame or housing 12 has a master locator or selection indicator 62. The dial 56 is rotated by the user to align one of the indicia 60 with the selection indicator 62 to thereby select that indicia as the ram retraction setting. In an alternate embodiment the selection indicator 62 could be on the dial and the indicia 60 could be on the frame or housing 12.

As noted above, the dial 56 is connected to the controller 42. Position of the dial 56 signals the controller of the size of connector which is being crimped. The controller is adapted to determine or select a rear location of the ram retraction based upon the position of the dial. For example, for a small size connector, the ram is retracted from its extended position a distance less than the distance or retraction for a larger size connector. Thus, for the small size connector the location of the end of the ram retraction versus its fullest possible retraction position is much more than the location of the end of the ram retraction for the large size connector from the fullest possible retraction position (the fully open, fully retracted location of the ram). In a preferred embodiment, the dial is connected electromagnetically to a drain pin of the release valve 52. However, it could be electromagnetically connected to a drain pin of another valve connected in series with the valve 52. In one type of preferred system, the user selectable control is adapted to consistently release a percentage of fluid from the ram cylinder back to the fluid reservoir each time the release system is actuated; a different percentage for each one of the user selected settings.

In operation, a user would set the dial 56 to indicate the size and material of the connector to be crimped. The user would actuate the activation trigger 36. The ram 20 is moved to an extended position on the frame to crimp the connector. Upon completion of the crimp, the user can actuate the release trigger 40. In an alternate type of tool, the tool might comprise an automatic release cycle when a predetermined hydraulic pressure is reached such that the user does not need to actuate the release trigger 40. The valve 52 can remain open until the controller 42 signals the valve 52 to close. The signal for the valve 52 to close will come from the controller 42 based upon the selected setting of the dial 56 and the characteristic(s) sensed by the sensor 58. For example, if the dial is set for a 2/0 Cu connector, the controller 42 will signal the valve 52 to close when the characteristic(s) sensed by the sensor 58 corresponds to the preprogrammed or configured characteristic corresponding to a desired ram retraction position for a crimped 2/0 Cu connector to be removed and a new 2/0 Cu connector to be installed with minimal unnecessary retraction of the ram from its extended position. For example, retraction would be about ⅝ inch for a 2/0 copper connector and about 1⅛ inch of retraction for a 500 kcmil copper connect. These are only some examples and should not be considered as limiting.

The invention is such that a user can, by rotating a dial that is integral to the battery tool, preset the limit of ram retraction by a certain amount. This can be selected by the user depending on the type of size of connector that is being crimped. The result is an exact amount of ram retraction after every crimp and activation of the release trigger. Battery consumption is minimized because the user needs only to advance the ram the minimum distance necessary in order to complete the remaining crimps; without having to waste battery power on advancing the ram a given distance prior to its contact with the connector it is intending to crimp.

The preferred embodiment of this invention would be a dial or collar that fits cylindrically over a portion of the back of the crimp head, or over the plastic housing of the battery tool. This dial, preferably, is engraved or imprinted with lines and numerals which are indicative of given wire or connector sizes and materials. It is commonly known that aluminum connectors usually have a much larger diameter for a given size conductor than a copper connector has. This is the case because aluminum is nominally 61 percent as conductive as copper for the same cross section and, therefore, aluminum conductors are sized larger in order to compensate for that limitation. So, aluminum connectors are larger than copper connectors for a given cross section of conductor (or, "wire size"). Therefore, the dial could be marked in order to compensate for the type of connector and the wire size of connector being crimped. As an example, the user would dial in "250 CU" to indicate that the user is connecting a copper connector sized for 250,000 circular mils (cmils) of copper conductor. Alternately, the user could dial in "500 AL" which would indicate that the user was connecting a 500,000 cmil conductor to a 500,000 cmil aluminum connector. The user could change to other connector sizes simply by rotating the dial, or could rotate the dial to a 'full' or 'open' position which would result in complete (or fully manual) ram retraction to its rearmost position.

The tick marks on the dial would correspond with a "master" tick mark on the crimp head or on the body of the tool. The alignment of the dial tick mark with the master tick mark could, underneath the dial, regulate an electronic switch mechanism or mechanical mechanism which would limit the amount of hydraulic fluid going to hydraulic fluid reservoir; which would thereby limit the retraction of the ram of the tool.

The invention allows for limiting ram retraction of the ram for user ease and optimization of battery life. This invention draws its need from users of battery powered crimping tools who frequently crimp the same size of connector repeatedly. Although the invention has been described in connection with a crimping tool, features of the invention could be used with a cutting tool as well as any other tool which used an extendable and retractable ram. Features of the invention could also be used in a pneumatic tool or an electrically actuated tool. For a hydraulic tool, the fluid reservoir could be located separate from the tool. Features of the invention could also be used in a non-battery operated tool, such as a hand operated tool. The retraction of the ram can be mechanically stopped, hydraulically stopped, and/or electrically stopped.

Figure 5:
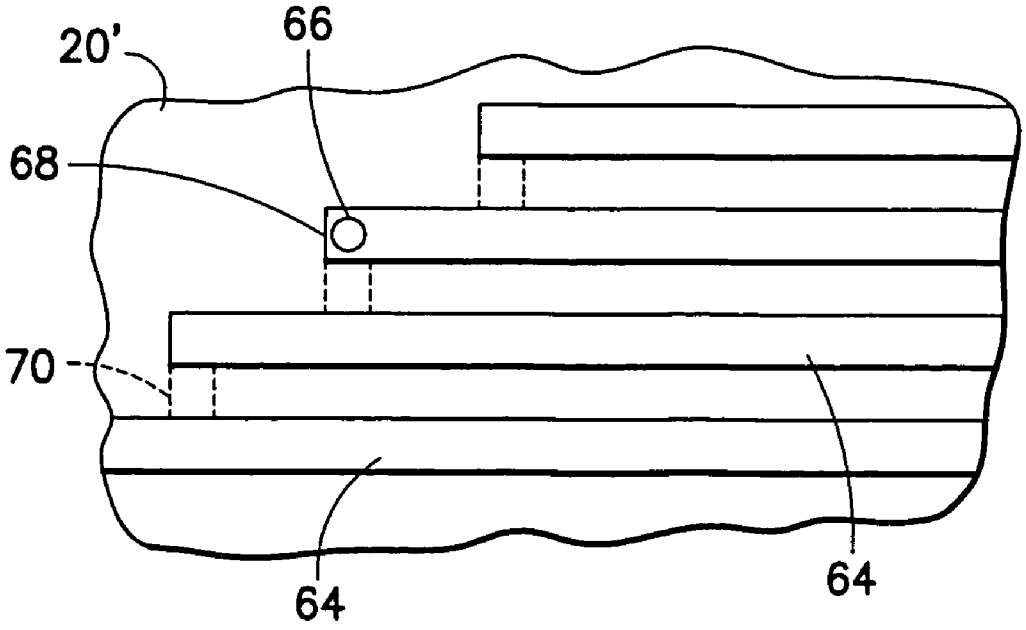
FIG. 5 is a partial view of portions of a ram and selection member of an alternate embodiment of the invention.

Referring also to FIG. 5, in an alternate embodiment a mechanically controlled system for limiting ram retraction could be provided. In this embodiment the ram 20' has grooves 64 along its length. The grooves 64 have different lengths. The selector member could comprise a pin 66 adapted to extend into one of the grooves 64. The groove which the pin extends into would be dependent upon the rotational position of the selector member. When the ram 20' is retracted, the pin 66 could act as a stop against an end 68 of the selected groove to form a stop limit to the rearward retraction of the ram. Connecting channels 70 could be provided to allow full retraction without having to extend the ram to an extended position before full retraction was possible from one of the shorter grooves.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A compression tool comprising:

a ram;

a drive system connected to the ram to extend the ram and allow retraction of the ram, wherein the drive system comprises a hydraulic system comprising a hydraulic pump;

a battery connected to the drive system to at least partially power the drive system; and a user selectable retraction control connected to the drive system, wherein the user selectable retraction control comprises at least three ram retraction settings which are adapted to be selected by a user to at least partially control respective different retraction stopping locations of the ram, and wherein the user selectable retraction control comprises an electromechanical connection to a drain pin of the hydraulic system to release a respective amount of fluid based upon the ram retraction setting selected by the user.

2. A compression tool as in claim 1 wherein the drive system comprises a user actuatable retraction member connected to the drive system to initiate retraction of the ram from an extended position.

3. A compression tool as in claim 1 wherein the user selectable retraction control comprises a rotatable selector member.

4. A compression tool as in claim 3 wherein the rotatable selector member comprises a rotatable dial.

5. A compression tool as in claim 4 wherein the rotatable dial comprises a rotatable collar generally aligned with a longitudinal axis of the ram.

6. A compression tool as in claim 1 wherein the ram retracting settings comprise indicia indicating an electrical connector size.

7. A compression tool as in claim 1 wherein the ram retracting settings comprise indicia indicating an electrical connector material.

8. A compression tool as in claim 1 wherein the respective different ram positions are each spaced from a fully retracted position of the ram.

9. A hydraulically operated, battery powered electrical connector crimp tool comprising:

a frame;

a battery connected to the frame;

a hydraulic drive system on the frame, wherein the hydraulic drive system comprises a hydraulic pump connected to the battery;

a ram connected to the hydraulic drive system, wherein the ram is adapted to be extended on the frame by hydraulic fluid from the hydraulic drive system;

a system for retracting the ram on the frame from an extended position, wherein the system for retracting the ram comprises a hydraulic fluid release system and a user selectable control, wherein the user selectable control comprises a movable selector member on the frame which is adapted to be moved between a first position and a second position to select from at least two partial retraction locations of the ram from the extended position, wherein the system for retracting the ram is configured to release a first amount of the hydraulic fluid to limit the ram to a first one of the at least two partial retraction locations when the movable selector member is in the first position, and wherein the system for retracting the ram is configured to release a second different amount of the hydraulic fluid to limit the ram to a second one of the at least two partial retraction locations when the movable selector member is in the second position.

10. An electrical connector crimp tool as in claim 9 wherein the user selectable control comprises an electromechanical connection to a drain pin of the hydraulic system to release a respective amount of fluid based upon the position of the user selectable control selected by the user.

11. An electrical connector crimp tool as in claim 9 wherein the hydraulic fluid release system comprises a user actuatable retraction member connected to the hydraulic system to initiate retraction of the ram from the extended position.

12. An electrical connector crimp tool as in claim 9 wherein the selector member comprises a rotatable dial.

13. A compression tool as in claim 9 wherein the selector member comprises a rotatable collar generally aligned with a longitudinal axis of the ram.

14. A compression tool as in claim 9 wherein the selector member comprises indicia indicating an electrical connector size.

15. A compression tool as in claim 9 wherein the selector member comprise indicia indicating an electrical connector material.

16. A compression tool as in claim 9 wherein the selector member comprises a location mark indicator, wherein a housing of the frame comprises indicia indicating an electrical connector size, and wherein the selector member is adapted to be rotated into registry with individual ones of the indicia.

17. A method of operating a hydraulically operated, battery powered electrical connector crimp tool comprising:

extending a ram of the tool to an extended position;

selecting from at least two different ram retraction settings on a user selectable control of the tool by a user, wherein the user selectable control is coupled to an electronic switch mechanism, and wherein each one of the at least two different ram retraction settings regulates the electronic switch mechanism to at least partially determine an amount of limited retraction of the ram from the extended position;

retracting the ram from its extended position, wherein a location of stopping of the ram retraction from its extended position is at least partially controlled by the ram retraction setting selected by the user on the user selectable control.

18. A method of manufacturing a hydraulically operated, battery powered electrical connector crimp tool comprising:

providing the tool with a system for retracting a ram on a frame from an extended position, wherein the system for retracting the ram comprises a hydraulic fluid release system, and wherein the hydraulic fluid release system comprises a user actuatable retraction member connected to the hydraulic system to initiate retraction of the ram from its extended position;

connecting a user selectable ram retraction control to a frame of the tool, wherein the user selectable ram retraction control comprises a plurality of ram retraction settings configured to limit a release of hydraulic fluid for stopping retraction of the ram from its extended position at a plurality of respective different ram retracted positions.

* * * * *